US011566447B2

(12) United States Patent
Promutico et al.

(10) Patent No.: US 11,566,447 B2
(45) Date of Patent: Jan. 31, 2023

(54) DOOR-LOCK DEVICE

(71) Applicant: BITRON S.p.A., Turin (IT)

(72) Inventors: Fabrizio Promutico, Turin (IT); Enrico Adiutori, Turin (IT); Giulio Raimondi, Turin (IT)

(73) Assignee: Bitron S.p.A., Turin (IT)

( * ) Notice: Subject to any disclaimer, the term of this patent is extended or adjusted under 35 U.S.C. 154(b) by 807 days.

(21) Appl. No.: 16/446,652

(22) Filed: Jun. 20, 2019

(65) Prior Publication Data

US 2019/0392662 A1 Dec. 26, 2019

(30) Foreign Application Priority Data

Jun. 22, 2018 (IT) ..... 102018000006542

(51) Int. Cl.
*E05B 47/02* (2006.01)
*E05B 47/00* (2006.01)
(Continued)

(52) U.S. Cl.
CPC ..... *E05B 47/02* (2013.01); *D06F 34/20* (2020.02); *D06F 39/14* (2013.01);
(Continued)

(58) Field of Classification Search
CPC . A47L 15/4259; E05B 17/22; E05B 47/0009; E05B 47/02; E05B 2047/0069;
(Continued)

(56) References Cited

U.S. PATENT DOCUMENTS 3,617,957 A * 11/1971 Brighenti ..... E05B 47/0009 337/77
3,626,403 A * 12/1971 Ive ..... G08B 13/08 340/541
(Continued)

FOREIGN PATENT DOCUMENTS

DE 102007031886 1/2009
WO WO 2015/121772 8/2015

OTHER PUBLICATIONS

Rapporto di Ricerca e l'Opinione Scritta [Search Report and the Written Opinion] dated Mar. 1, 2019 From the Ministero Dello Sciluppo Economico, Direzione Generale Sviluppo Produttivo e Competitivita, Ufficio Italiano Brevetti e Marchi Re. Application No. IT20180006542. (10 Pages).
(Continued)

*Primary Examiner* — Mark A Williams

(57) ABSTRACT

The present invention relates to a door-lock device (100) for locking and unlocking a door of a household appliance, such as a washing machine, a dishwasher and the like, comprising a first (110) and a second (120) electrical connecting terminal, a closing switch (130) series connected to said first connecting terminal (110) or to said second connection terminal (120), and arranged to close when the door of said household appliance is closed, an actuator (140), connected to said first (110) and second (120) connecting terminals, comprising at least one coil (141, 142), suitable to generate a magnetic field capable of causing the locking and unlocking of said door, and a Hall sensor (151) connected between said first (110) and said second (120) terminal, arranged in parallel with said actuator (140), said Hall sensor (151) being arranged so as to detect said magnetic field of said actuator (140).

16 Claims, 10 Drawing Sheets

(51) Int. Cl.

| | |
|---|---|
| ***E05B 47/06*** | (2006.01) |
| ***G07C 9/00*** | (2020.01) |
| ***D06F 34/20*** | (2020.01) |
| ***D06F 39/14*** | (2006.01) |

(52) U.S. Cl.
CPC ..... *E05B 47/0002* (2013.01); *E05B 47/0038* (2013.01); *E05B 47/0607* (2013.01); *G07C 9/00174* (2013.01)

(58) Field of Classification Search
CPC ..... E05B 47/0002; E05B 47/0001; E05B 2047/0079; E05B 47/0038; E05B 47/0607; G07C 9/00174
See application file for complete search history.

(56) References Cited

U.S. PATENT DOCUMENTS 4,620,735 A * 11/1986 Heydner ..... D06F 37/42 292/144
6,363,755 B1 * 4/2002 Hapke ..... D06F 37/42 68/12.26
2008/0094158 A1 * 4/2008 Schmid ..... H01H 27/002 335/291
2010/0192994 A1 * 8/2010 Christmann ..... A47L 15/4259 340/686.1
2011/0133490 A1 * 6/2011 Berginc ..... D06F 37/42 292/144
2012/0175894 A1 * 7/2012 Hapke ..... E05B 47/0001 292/144
2015/0361690 A1 * 12/2015 Hintz ..... E05B 47/00 292/138
2017/0004933 A1 * 1/2017 Rocchitelli ..... H01H 51/06
2017/0011866 A1 * 1/2017 Rocchitelli ..... D06F 39/14
2017/0058566 A1 * 3/2017 Rocchitelli ..... A47L 15/4259
2019/0390393 A1 * 12/2019 Promutico ..... G05B 9/02

OTHER PUBLICATIONS

Notification of Office Action and Search Report dated Sep. 6, 2021 From the State Intellectual Property Office of the People's Republic of China Re. Application No. 201910542015.3 and Its Translation of Office Action Into English. (15 Pages).

* cited by examiner

DOOR-LOCK DEVICE

RELATED APPLICATION

This application claims the benefit of priority of Italian Patent Application No. 102018000006542 filed on Jun. 22, 2018, the contents of which are all incorporated by reference as if fully set forth herein in their entirety.

FIELD AND BACKGROUND OF THE INVENTION

This invention concerns a door-lock device.

More specifically, the invention concerns a door-lock device, in particular for household appliances, designed and manufactured mainly to allow a circuit simplification and a high operating stability, such as to allow an easy adaptability of the same to the control logic of the household appliance on which it is installed. The circuit simplification also allows to have a lower number of door-block components.

In the following the description will be directed to a washing machine or a household appliance in general, but it is clear that the same should not be considered limited to this specific use.

As is well known today, door-lock devices allow to detect when a door of a household appliance is closed and eventually lock it before starting, by a control logic unit, the operating program of the household appliance, after having issued a signal on the locking status of the door itself.

In general, a door-lock device must be capable of providing the central control unit of the household appliance with certain signals on the status of the door, so that the latter can eventually start the above mentioned operating program.

In order for this to take place, it is necessary that there is both a mechanical as well as an electrical interaction, so as to allow the generation of signals that can be interpreted by the logic control unit, so that the latter can determine with certainty the state of the door and in any working condition.

The door-lock devices currently available on the market have several control terminals (generally more than or equal to three). This implies a remarkable circuit complexity. In addition, this often results in a low compatibility of said door-lock devices with different types of household appliances, on which they can be installed.

It is clear that this procedure is expensive in terms of cost and production process.

SUMMARY OF THE INVENTION

In light of the above, it is, therefore, scope of the present invention providing a door-lock device with as few terminals as possible, at least two, that is easily adaptable to the different types of logic control units, which are equipped in household appliances, such as washing machines, dishwashers and the like, so that the latter can be easily programmed and said door-lock devices can be easily installed in different types of household appliances.

Another scope of the invention is to limit the use of mechanically coupled systems, so as to reduce the risk of accidental breakage of said door-lock devices or to reduce their maintenance.

It is therefore specific object of the present invention a door-lock device for locking and unlocking a door of a household appliance, such as a washing machine, a dishwasher and the like, comprising a first and a second electrical connecting terminal, a closing switch, series connected to said first connecting terminal or to said second connection terminal, and arranged to close when the door of said household appliance is closed, an actuator, connected to said first and second connecting terminals, comprising at least one coil, suitable to generate a magnetic field capable of causing the locking and unlocking of said door, and a Hall sensor connected between said first and said second terminal, arranged in parallel with said actuator, said Hall sensor being arranged so as to detect said magnetic field of said actuator.

Always according to the invention, said Hall sensor may comprise three terminals, wherein two terminals are connected to said first and second connecting terminals, while the third terminal is connected, by means of a resistor, to said first connecting terminal.

Still according to the invention, said actuator may comprise a first and a second coil.

Advantageously according to the invention, said actuator may be operatively associated to an actuating assembly, wherein the field generated by said at least one coil causes to lock and unlock said door of said household appliance.

Further according to the invention, said actuating assembly may comprise an actuating member pivoted about a fulcrum, so that it can rotate, wherein said actuating member is capable of assuming a first and a second position, according to the magnetic field generated by said at least a coil, a pin coupled at an end to said actuating member and such that, when said actuating member assumes said first position, said pin is retracted, and when said actuating member assumes said second position, said pin is extracted, so as to cause the locking of said door when it is closed.

Preferably according to the invention, said actuating member may be is "V"-shaped and said fulcrum is arranged on the vertex.

Always according to the invention, said actuating member may be made of magnetically permeable material.

BRIEF DESCRIPTION OF THE SEVERAL VIEWS OF THE DRAWINGS

The present invention will be now described, for illustrative but not limitative purposes, according to its preferred embodiments, with particular reference to the figures of the enclosed drawings, wherein.

In the various Figures, similar parts will be indicated by the same reference numbers.

DESCRIPTION OF SPECIFIC EMBODIMENTS OF THE INVENTION

Figure 1:
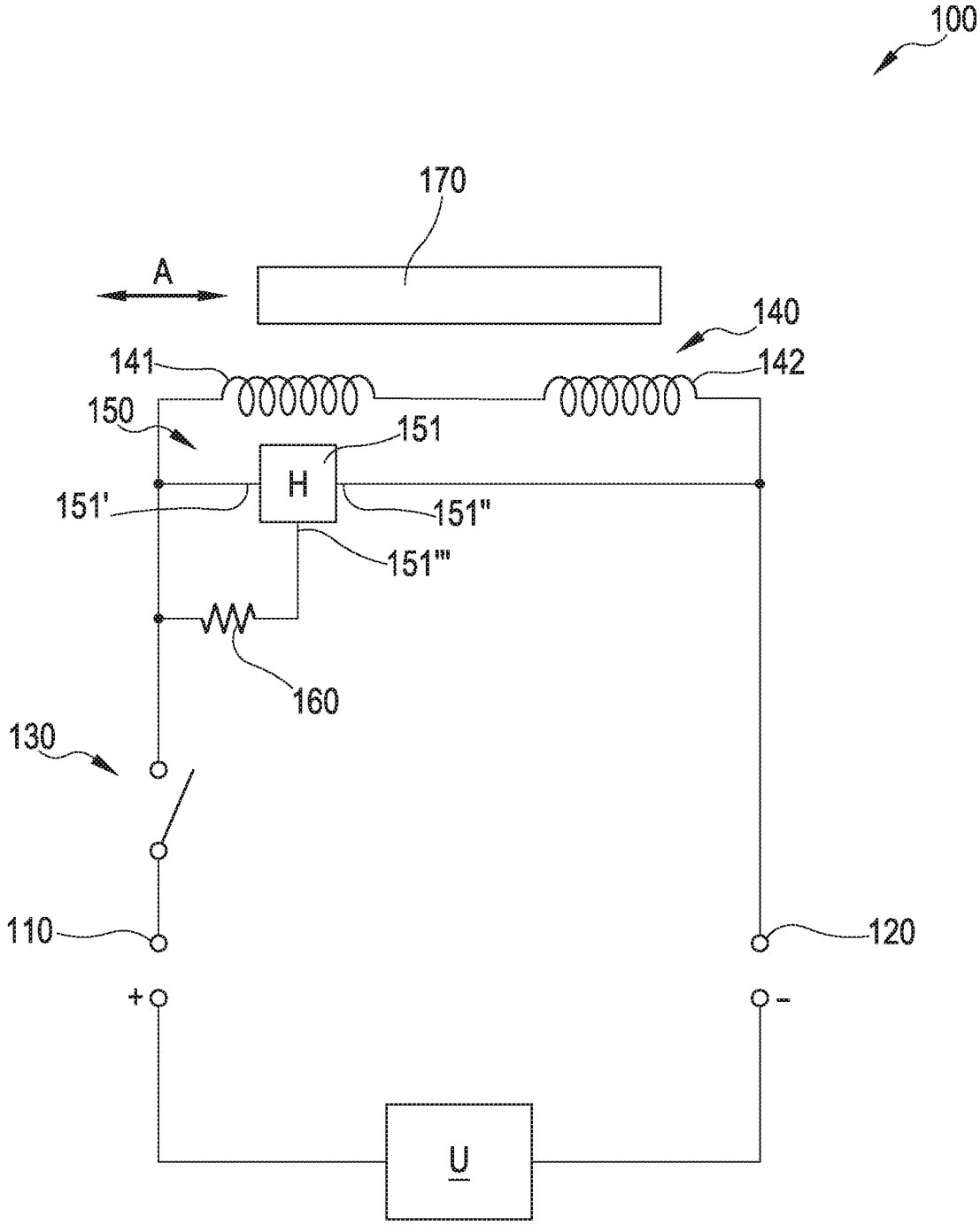
FIG. 1 shows the electrical diagram of a first embodiment of a door-lock device according to the present invention.

With reference to FIG. 1, a first embodiment of a door-lock device 100 according to the present invention is shown, for locking and unlocking a door of a household appliance (not shown in the Figures), such as a washing machine, a dishwasher and the like.

The household appliance is equipped with a central control unit U, configured to run a work program, for example a cloth washing program, in case of a washing machine, or a dishwashing program, in case of a dishwasher.

Another purpose of this central control unit U is to monitor the state of the door of the household appliance by the state of the door-lock device 100.

A further purpose of this central control unit U is also that of sending commands for actuating the door-lock device 100 to modify its status, i.e. the status of the door of the household appliance.

The door-lock device 100 comprises a first 110 and a second 120 electrical connecting terminal, which can be connected to said logic control unit U of said household appliance, and a closing switch 130, connected in series with said first connecting terminal 110 (but equivalently it may be connected in series with said second connecting terminal 120) and arranged so as to close when the door of the household appliance is closed (not shown in the figure).

In particular, when the door of the household appliance is open, the closing switch 130 remains open preventing any supply of said door-lock device 100.

The door-lock device 100 also comprises an actuator 140, which in the case at issue comprises a first 141 and a second 142 coil, connected together in series and between said first 110 and second 120 connecting terminal.

Said block-door device 100 also comprises sensor means 150, comprising, in the present embodiment, a Hall sensor 151, having three terminals 151', 151" and 151'", two of which, namely the terminals 151' and 151", are connected to said first 110 and second 120 connecting terminal (therefore being in parallel with said actuator 140), while the third terminal 151'" is connected, by a bias resistor 160, to said first connecting terminal 110.

Said Hall sensor 151, when appropriately polarized, or when a suitable biasing voltage is applied between said first 151' and said second 151" terminal, is capable of detecting the surrounding magnetic field, i.e. it can modify its state on the basis on variations of the magnetic field, which it is subjected to (as it is known in the art), thus establishing a non-zero impedance at the ends of said first 151' and second 151" terminals.

Instead, if said Hall sensor 151 is power supplied with an opposite polarization, said Hall sensor 151 behaves substantially like an open circuit.

The door-lock device 100 also comprises an actuating assembly 170, operatively connected to said actuator 140, and in particular, in the present embodiment, to said first 141 and second 142 coils.

In particular, said actuating assembly 170 is capable of effectively locking and/or unlocking (mechanically) the door of the household appliance, on which the door-lock device 100 is installed.

In particular, in the present embodiment, in order to be operatively connected with said first 141 and second 142 coils, said actuating assembly 170 is preferably made of magnetically permeable material, so as to create a magnetic circuit with variable characteristics within the door-lock device 100. In this magnetic circuit the Hall sensor 151 is inserted, which therefore is able to read the variations of the magnetic flux of the magnetic circuit inside the door-lock device 100. The variations of the magnetic circuit of the door-lock are associated with variations in the state of the door-lock device 100 and in particular with the locked or unlocked conditions of the door.

Therefore, in the magnetic circuit of the door-lock device 100, various magnetic states are realized, which are uniquely linked to the states of the door-lock device 100 (door open, door closed/locked, door closed/unlocked).

In general, moreover, said actuating assembly 170 is capable of assuming an unlocking position, in which, when the door of the household appliance is closed but is not held locked, such that the door of said household appliance can be opened again by the user, and a locking position, in which, when the door of the household appliance is closed, it is closed locked to prevent it from being opened.

As will be better explained below, said actuating assembly 170 is capable of passing from said unlocking position to said locking position, due to the magnetic field generated by said first 141 and second 142 coils.

Said actuating assembly 170 can be made in different distinct ways.

In FIG. 1 the actuating assembly 170 is shown only schematically, just to show that it is capable of assuming the two above-mentioned locking and unlocking positions, represented schematically with the arrow A, which has a double direction.

However, by way of example only, said actuating assembly 170 may comprise a "V"-shaped actuating member pivoted to the vertex on a fulcrum and rotating thereon. Again, said actuating assembly 170 can be movable linearly and moved by the magnetic field of said actuator 140.

An example of an actuating assembly 170 may be that disclosed in FIGS. 7 and 8 of the Italian patent application number 102017000039143 owned by the Applicant. In particular, in said FIGS. 7 and 8 there is an open V-shaped actuating member pivoted at a point and capable of rotating, so as to assume two different positions, in which each branch of the actuating member rests on a base. It is noted that, according to the position assumed by this element, the magnetic circuit created by the magnetic field generated by the reported coils varies, as better defined below.

This actuating assembly acts on a locking pin (not shown in FIG. 1), which allows, with its movement, to lock or unlock the door of a household appliance and therefore to make the door of a closed household appliance pass from the locked to the unlocked condition.

An example is shown in the Italian patent application number 102017000039143 owned by the Applicant.

Figure 1A:
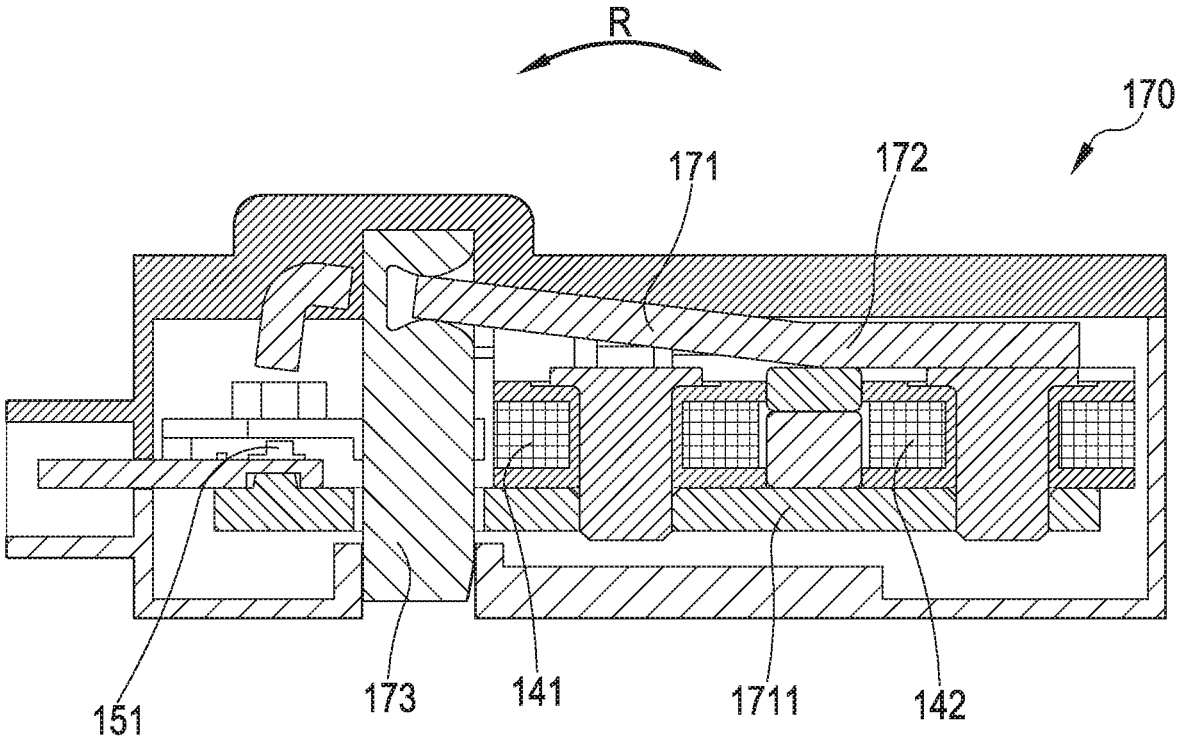
FIG. 1A shows an embodiment of an actuating assembly relating to the door-lock device according to FIG. 1.

With reference to FIG. 1A, an embodiment of an actuating assembly 170 is shown.

Said actuating assembly 170 comprises a "V"-shaped actuating member 171 pivoted at the vertex 172, so that it can rotate clockwise or counterclockwise according to the arrow indicated with the letter R.

The two coils 141 and 142 are arranged in a planar fashion with respect to said actuating member 171.

The actuating member 171 is made of magnetically permeable material, as well as the element, in which the two coils 1711 are fixed, so as to create a magnetic circuit (which can also assume different states based on the position change of the actuating member 171), which closes on the Hall sensor 151.

At one end of said actuating member 171 a pin 173 is coupled, such that, when said actuating member 171 is rotated to the right (i.e. in a first direction), the pin 173 is retracted, whereas when the element 171 is rotated to the left (i.e. in a second direction, opposite to said first direction), the pin 173 is withdrawn, so that it can interfere with other mechanical elements, such as a slider and the like, to lock the door of the household appliance.

Therefore, said actuating member 171 can assume said release position, when the pin 173 is retracted, to said locking position when said pin 173 is withdrawn.

In particular, when the coils 141 and 142 are supplied according to a first polarization, the actuating member 171 is positioned in said unlocking position. Instead, when the coils 141 and 142 are supplied according to a second polarization, said actuating member 171 is positioned in said locking position.

The operation of the door-lock device 100 described above is as follows.

When the door is open, the closing switch 130 is also open. Consequently, the circuit of the door-lock device 100 cannot be powered. In this state, the central control unit U will read an impedance at the ends of the terminals 110 and 120 equal to infinite and associate this value with the open door condition.

When the door is closed, the closing switch 130 is closed in its turn. The central control unit U in this configuration reads an impedance at the ends of the terminals which is that of the coils 141 and 142, which is associated with the condition of unlocked open door. Thus, the central control unit U of the household appliance can supply the door-lock device 100 through the first 110 and the second 120 electrical connecting terminal.

To lock the door, the central control unit U power supplies said door-lock device 100 with a direct current DC supply voltage, having a first polarity.

The first polarity of said supply voltage is such as to activate the Hall sensor 151.

Moreover, as a result of said DC current supply voltage, which has a first polarity, a supply current I passes through said first 141 and second 142 coils (independently of the state of the Hall sensor), which generates a predefined magnetic field, which interacts with said actuating assembly 170, causing it to pass from said unlocking position to said locking position.

In particular, referring again to FIG. 1A, the actuating member 171 passes from said unlocked position to said locked position, causing the extraction of said pin 173 and the variation of the magnetic circuit within the door-lock device 100, caused by the magnetic field of said coils 141 and 142.

At the same time, the Hall sensor 151 detects the above mentioned variation of the magnetic field inside the magnetic circuit defined in the door-lock device 100, due to the displacement of the actuating assembly 170, which modifies, thanks to its magnetic permeability, the magnetic field surrounding said Hall sensor 151.

The Hall sensor 151 then modifies the impedance at the ends of its terminals.

This impedance changes at the ends of said first 110 and said second 120 controlling terminal is detected by said central control unit U, which thus gets the signal that the door, in addition to being closed, is also locked.

To unlock the door, the central control unit U changes the power supply polarity of the door-lock device 100.

In this case, the magnetic field generated by said first 141 and second 142 coils changes, so as to cause said actuating assembly 170 to pass from said locking position to said unlocking position.

In particular, referring to FIG. 1A, the actuating member 171 passes from said locking position to said unlocking position, retracting the pin 173.

The Hall sensor 151 is now reverse biased, thus substantially stopping to operate. The voltage at the ends of said first 110 and second 120 connecting terminal remains the supply voltage supplied by the central control unit U, but the impedance changes again, thus allowing said central control unit U to detect that the door is actually located in the unlocking state.

In a variant of said first embodiment, the actuator 140 can comprise a single coil 141.

Figure 2:
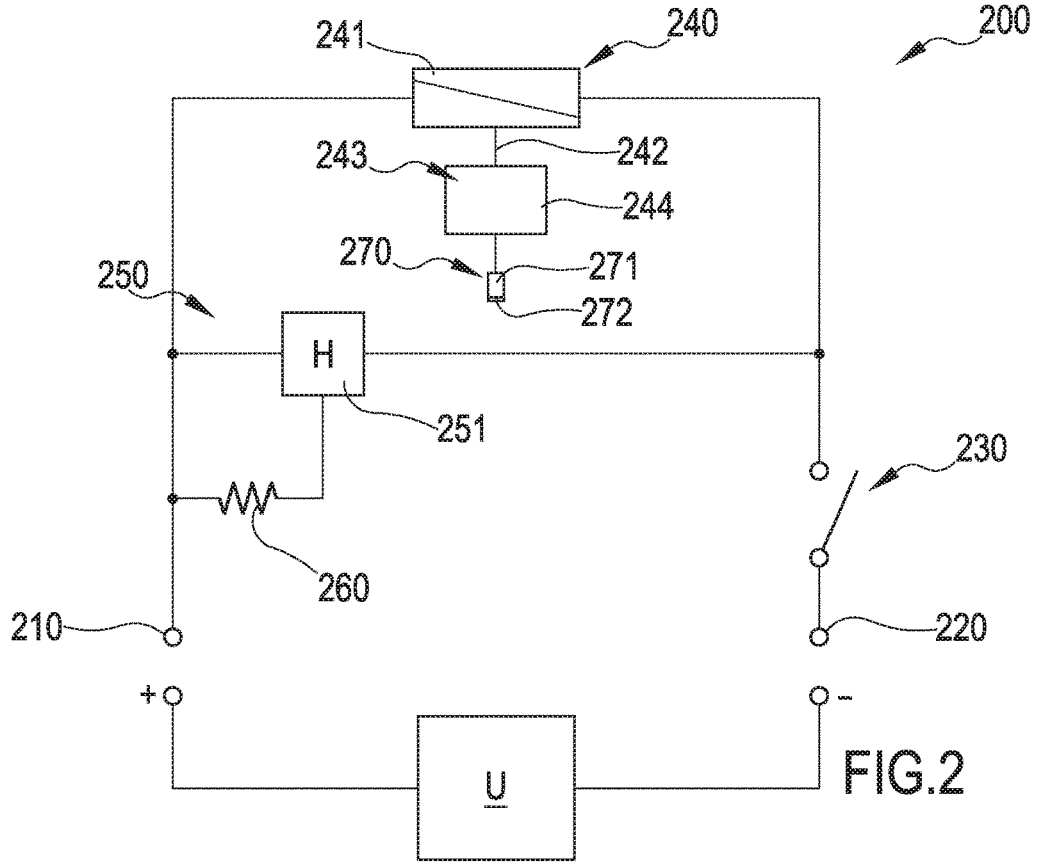
FIG. 2 shows the electrical diagram of a second embodiment of a door-lock device according to the present invention.

FIG. 2 shows a second embodiment of a door-lock device 200 of the present invention.

In the present case, as can be seen, the closing switch 230 is series connected with said second connecting terminal 220. Said closing switch 230 could however be connected in an equivalent manner in series to said first connecting terminal 210.

Said actuator 240 comprises a coil 241, comprising a movable core 241' (see also FIG. 2A), a desmodromic guide system 243, constrained to said movable core 241', capable of driving the movement of the actuating assembly 270 in such a way that, upon activation of said actuator 240, said actuating assembly 270 assumes a first position, while, following the subsequent activation of said actuator 240, said actuating assembly 270 assumes a second position.

In particular, said desmodromic guide system 243 comprises a path 244 and a bar or tip 245, whose end is constrained to move along said path 244.

Said desmodromic guide system 243 is then coupled with a rotating member 246, which can be rotated around a pin, which in its turn moves a locking pin 271 (better defined in the following), which, according to the rotation of said rotating member 246, can assume a retracted position (for unlocking the door) or an extracted position (for locking the door).

The operation of the desmodromic guide system 243 provides that the movable core 241' is extracted, following a first activation of said coil 241, supplied according to a polarization.

The desmodromic guide system 243 thus moves to a first position, locking itself in it following the positioning of the bar 245 on the path 244. In this way, the rotating member 246 rotates, extracting the locking pin 271.

Following a second activation of said coil 241, according to the same polarity as the previous activation, the movable core 241' moves again said desmodromic guide system 243, releasing said bar 245, from the position in which it was and making it follow the path 244, so that said desmodromic guide system 243 assumes a new stable position. In particular, by rotating the rotating member 246 again, the locking pin 271 can be retracted.

Figure 2A:
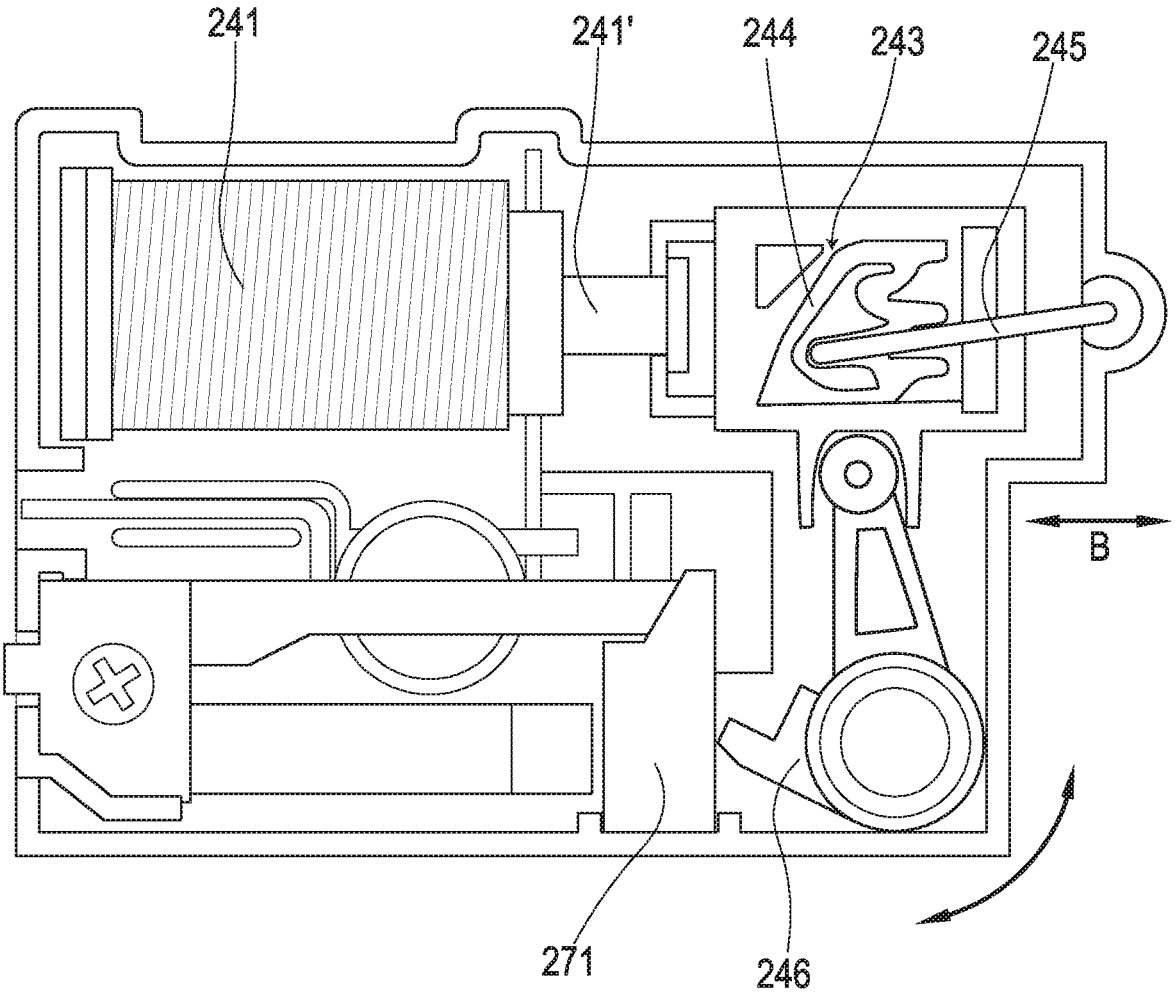
FIG. 2A shows a detail of the door-lock device of FIG. 2.

The actuating assembly 270 is connected with said desmodromic guide system 243, so that, following two consecutive activations of the coil 241 with the same polarization, it is possible to move said actuator assembly 240, making it pass from a first to a second position, as schematically shown with the arrow B of FIG. 2A, which has two directions.

Furthermore, differently with respect to said first embodiment of said door-lock device 100, in the door-lock device 200 the actuating assembly 270 is the lock pin 271, which is provided with a permanent magnet 272.

Said locking pin 271 is capable, as seen, controlled by the desmodromic guide system 243, also of assuming an unlocking position, typically a retracted position, in which it does not block the door of the household appliance, in which said door-lock device 200 is installed, and a locking position, typically an extracted position, in which directly or indirectly, for example by means of a slider (not shown in the figures) or similar movable members, locks the door in a closed position.

The locking pin 271 assumes said locking and unlocking position driven by said desmodromic guide system 243.

The Hall sensor 251 of said sensor means 250 is arranged close to said locking pin 271, so as to detect the variation of magnetic field due to the variation of the position of the permanent magnet 272, when the locking pin 271 passes from said unlocking position to said locking position and vice versa.

The operation of the door-lock device 200 described above is as follows.

Similarly to the first embodiment, when the door is open, the closing switch 230 remains open and therefore the door-lock device 200 is not power supplied.

When, on the other hand, the door of the household appliance is closed, the closing switch 230 is closed and the logic control unit U of the household appliance is electrically connected to the door-lock device 200.

In this way, said control logic unit U is capable of driving the actuator 240 by means of pulses having all the same polarization.

Moreover, the circuit of the door-lock device 200 is always supplied with a polarization such as to operate the Hall sensor 251. This power supply is not continuous over time, but realized with consecutive pulses, which are given to operate the door-lock or read its status (locked or unlocked door).

Following a first impulse the coil 241 is supplied and moves the mobile core 241', which in its turn activates the desmodromic guide system 243.

The locking pin 271 passes from said unlocking position, in which it is retracted, to said locking position, in which it is extracted. Thus, even the permanent magnet 272 changes its position in the space. This changes the magnetic field surrounding the Hall sensor 251 located close to it, which then changes its impedance and that at the ends of said first 210 and second 220 connecting terminal. This impedance variation is detected by said logic control unit U, which is thus capable of recognizing that the door is not only closed, but also locked.

Also in this case a bias resistor 260 of the Hall sensor 251 is provided.

To unlock the door, it is sufficient for the control logic unit U to transmit a further pulse, similar and of the same polarity as the previous one, so that the coil 241 can, by said desmodromic guide system 243, carry said locking pin 271 from said locking position at said unlocking position.

Also in this case, due to the movement of the locking pin 271, also the permanent magnet 272 changes its position in the space, thus also modifying the magnetic field surrounding the Hall sensor 251.

In this way, the control logic unit U detects a new impedance variation at the ends of said first 210 and second 120 connecting terminal, detecting that the door has been unlocked.

As an alternative to the linear desmodromic system as the one indicated, a rotating cam system can be used, such as the one disclosed in the patent EP1621658, in which a rotating system ensures the two positions of the locking pin following successive actuations of the actuator 240.

Figure 3:
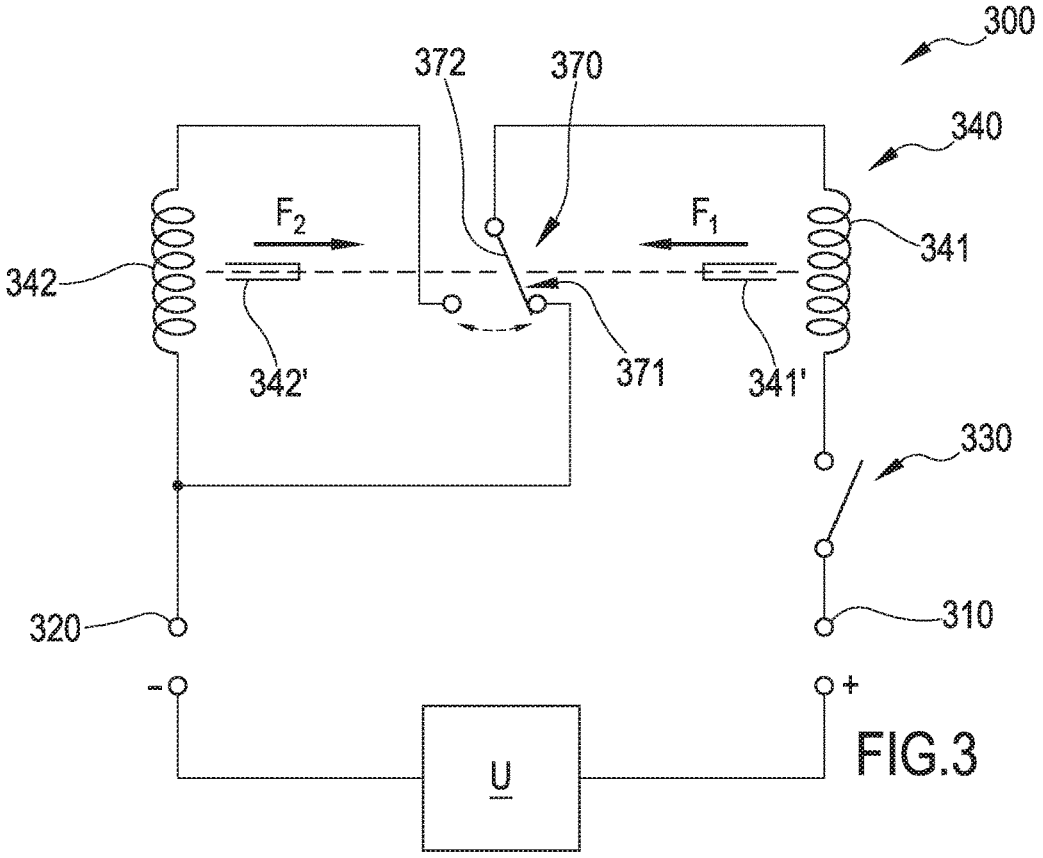
FIG. 3 shows the electrical diagram of a third embodiment of a door-lock device according to the present invention.

FIG. 3 shows a third embodiment of the door-lock device 300 object of the present invention.

In this case, said door-lock device 300 provides that the actuator 340 comprises a first 341 and a second 342 coil.

The actuating assembly 370 comprises a control switch 371, whose selector 372 can assume a first position, in which it connects said first coil 341 to said second connecting terminal 320, and a second position, in which it connects in series said second coil 342 to said first coil 341 and then to said second terminal 320.

In addition to the above, said selector 372 provides a toggle spring system 373 (see FIG. 3A, which shows the different operating states of the toggle spring 373 and of the selector 372), which holds said selector 372 in the two positions in a stable manner.

Examples of toggle springs are available in the prior art, such as for example (in a form not perfectly adapted to the case at issue, but which allows to understand its operation) that described in the patent application U.S. Pat. No. 6,118,090 in FIGS. 6 and 7.

This toggle spring system allows to support the movement of the selector 372 in the passage from the first to the second position, when there is no more power supply of the first coil or of the series of the first and second coils.

Equivalent magnetic-pass-through systems are possible as in the Italian patent application number 102017000039143, owned by the Applicant, in which, once the fulcrum point of the "V"-shaped element has been overcome, the magnetic circuit allows the passage to the next stable position without further electric power supply by the coils.

The operation of the door-lock device 300 described above is as follows.

Also in this case, in order to drive the door-lock device 300, or to transmit a locking or unlocking signal, the central control unit U does not need to change the polarization.

When the closing switch 330 is closed (following the closing of the door of the household appliance), the selector 372 of the control switch 371 is held in said first position by said toggle spring 373. Said spring 373 is in the operating position indicated with (i) of FIG. 3A (it is considered that this figure is of principle).

To lock the door, the central control unit U supplies the door-lock device 300, thus supplying the first coil 341, which exercises a force on a movable core 341'.

Figure 3A:
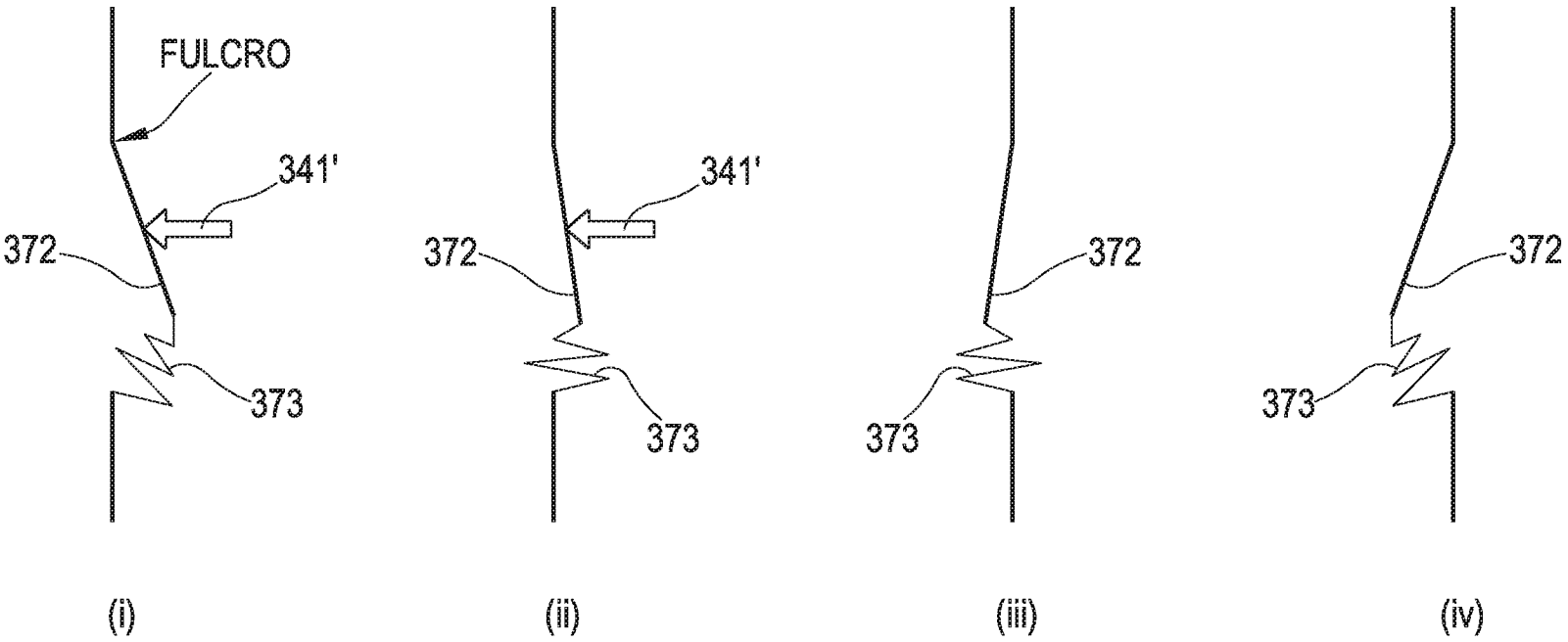
FIG. 3A shows an operating diagram of a fastening pass spring of the door-lock device according to FIG. 3.

The force exerted by said movable core 341' compresses the toggle spring 373 (see step (ii) of FIG. 3A) without opening the electrical contact 370 and thus allowing the current to continue flowing in the first coil 341 and therefore the respective movable core 341' being pushed.

Once a certain threshold has been overcome (or, in the case of a rotary system, the rotation fulcrum of the selector 372), the force generated by the first coil 341 by means of the movable core 341' exceeds the activation point of the toggle spring system 373, so that the selector 372 can pass from said first to said second position without further contribution of the first coil 371, but only the elastic energy accumulated in the previous phase by the toggle spring 373.

In the passage from said first to said second position, said selector 372 exerts a resistance (or it is accumulating energy in the toggle spring 373).

The passage of said selector 372 from said first to said second position causes a variation of impedance at the ends of said first 310 and second 320 connecting terminal, due to the series of the two coils 341 and 342, which is detected by the central control unit U, which therefore detects that the door is locked, since a suitable mechanical door-lock device (not shown in the figure) is integral with the selector 372 and forms part of the actuating assembly 370. As a result, the toggle spring 373 assumes the position (iv) shown in FIG. 3A.

To unlock the door of the household appliance, the central control unit U again power supplies said door-lock device 300. In this case, however, since the selector 372 is in said second position, both said first coil 341 and said second coil 342 are supplied. The second coil has a greater number of turns than the first coil and a winding direction of the turns such as to generate a displacement of its movable core 342' in the opposite direction with respect to the core of the first coil 341'. First and second movable cores 341' and 342' of the coils 341 and 342 both interact with the locking pin (not shown) and with the selector 372.

Due to said suitable dimensioning of the unlocking signal by the control unit U the following force on the selector exerted by the two coils 341 and 342 is such as to bring the selector 372 back to the original unlocking position.

FIG. 3 shows a force F2 greater than the force F1 generated respectively by the coils 342 and 341 in the transition condition from locked to unlocked.

Beyond a certain threshold, the force exerted by the movable core 342' of said second coil 342, together with the returning force of said toggle spring 373, exceed the resistance exerted by said first coil 341 by means of the respective movable core 341', so as to cause the selector 372 of the control switch 371 to pass from said second position to said first position, so that the position (i) shown in FIG. 3A is obtained again. In this case the arrows indicated in FIG. 3A are not to be considered, which refer to the previous locking step, in which only the movable core 341' acts.

Figure 4:
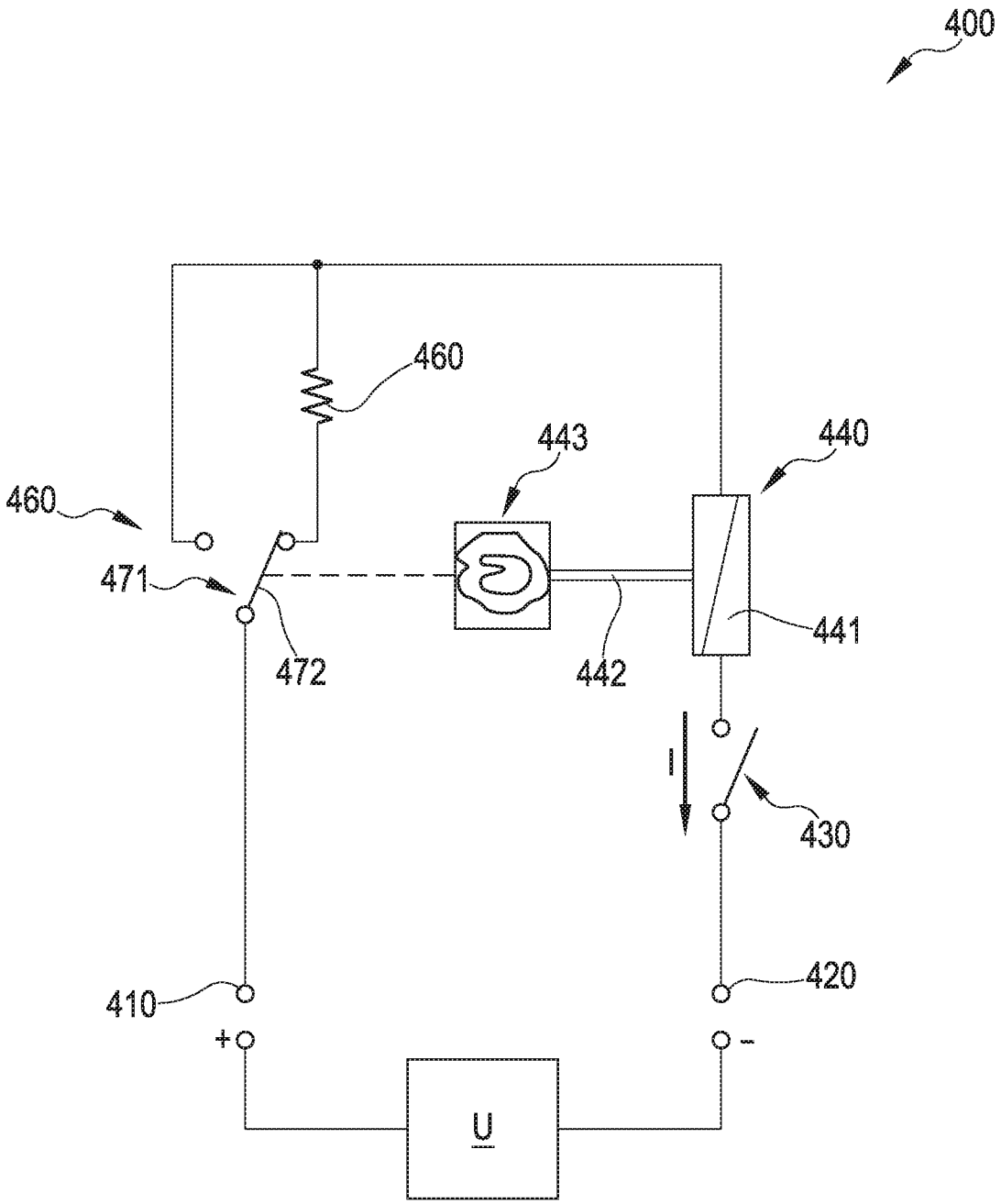
FIG. 4 shows the electrical diagram of a fourth embodiment of a door-lock device according to the present invention.

With reference to FIG. 4, a fourth embodiment of a door-lock device 400 according to the present invention is observed.

The actuating assembly 470 of the present embodiment also comprises a control switch 471, the selector 472 of which is integral with a mechanical element (not shown in the figure), which actually physically locks the door of the household appliance.

Said selector 472 is capable of assuming a first position, in which it sets in series with said first connecting terminal 410 and the actuator 440, a resistance 460, and a second position, in which said resistor 460 is bypassed.

The door-lock device 400 comprises an actuator 440, having a coil 441, connected in series with said second connecting terminal 420 and to said control switch 471, and having a movable core 442. The actuator 440 also comprises a desmodromic guide system 443 (similar to that shown and described in FIG. 2A), capable of driving the movement of the actuating assembly 470.

In particular, the actuator 440 is configured in such a way that, upon activation, said control selector 472 passes from said first position to said second position; while, following a further activation of said actuator 440, said control selector 472 passes from said second position to said first position. This is caused by the desmodromic guide system 443. A further toggle spring system is integral with the selector in a manner entirely equivalent to that of FIGS. 3 and 3A (not shown).

The operation of the door-lock device 400 described above is as follows.

Once the door is closed, and therefore the closing switch 430 is closed, the logic control unit U can supply the door-lock device 400.

Even in this case, it is not necessary to change the polarity of the power supply.

Assuming that the selector 472 is in said first position, in which the actuating assembly 470 keeps the door unlocked, following a first power supply, the logic control unit U will initially read a first impedance to the ends of said first 410 and second 420 connection terminal.

As a result of this supply, which might have a specific time duration, however, the coil 441 of said actuator 440 moves a lever mechanism or crank mechanism 442 (known in the prior art and for example in a non-limiting manner as indicated in FIG. 2A), causing the system connected to the selector 472 to assume a second position on the path 444 of said desmodromic guide system 443.

In this way, the selector 472 of said control switch 471, which is integral with a locking member, not shown in the Figure and forming part of the actuating assembly 470, will pass from said first to said second position.

In this way, at the same time, the blocking element will block the door and said resistor 460 will be bypassed, so as to vary the impedance of the circuit at the ends of said first 410 and second 420 connecting terminal.

Thus, the central control unit U, as a consequence of this impedance variation at the ends of said first 410 and second 420 connecting terminal, will be capable of detecting that the door is, besides being closed, also locked.

To unlock the door, the central control unit U will supply again, with the same polarity, said locking-door device 400, so that said coil 441 of said actuator 440 moves said connecting member 442, such that its end can return to an initial position, constrained to move on the path 444 of said desmodromic guide system 443. In this way, the selector 472 of said control switch 471 passes from said second position, in which the resistor 460 is bypassed, to said first position, in which the resistor 460 is connected in series between said first 410 and second 420 connecting terminal.

In this way, the central control unit U of said household appliance on which the door-lock device 400 is installed is capable of detecting again an impedance variation, detecting that the door has been unlocked.

Figure 5:
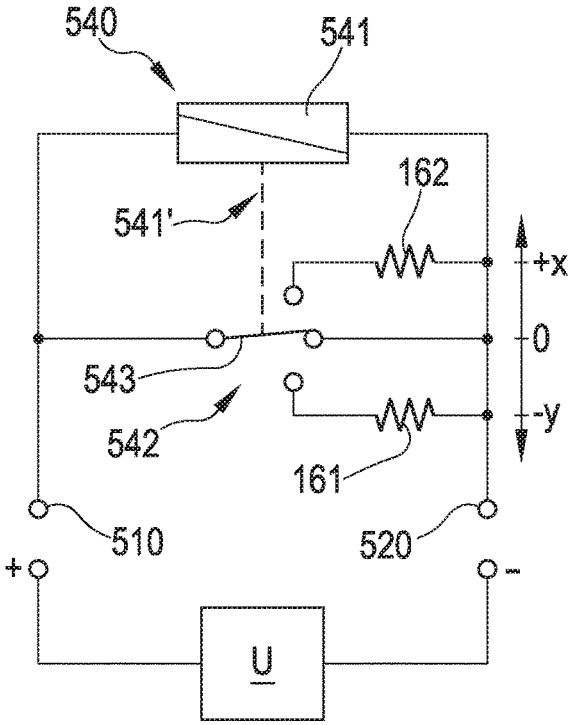
FIG. 5 shows the electrical diagram of a fifth embodiment of a door-lock device according to the present invention, in which the door of the household appliance is open.

With reference to FIG. 5, a fifth embodiment of the door-lock device 500 according to the present invention is observed.

In particular, as can be seen in the present case, an actuator 540 is provided, which in particular comprises a coil 541, capable of driving a movable core 541' in different positions.

Said mobile core 541' is capable in particular of assuming three positions:

- an intermediate position, wherein it shortcircuits said first connecting terminal 510 and said second connecting terminal 520;
- a first position, in which it connects a first resistance 161 between said first connecting terminal 510 and said second connecting terminal 520 and in parallel with said actuator 540;
- a second position, in which it connects a second resistance 162 between said first connecting terminal 510 and said second connecting terminal 520 and in parallel with said actuator 540.

Said movable core 541' of said coil 541 is operatively connected to the selector 543 of a switch 542. In turn, said selector 543 interacts with an actuator assembly 570, shown in FIGS. 5D, 5E and 5F, which will be better described in the following.

Figure 5A:
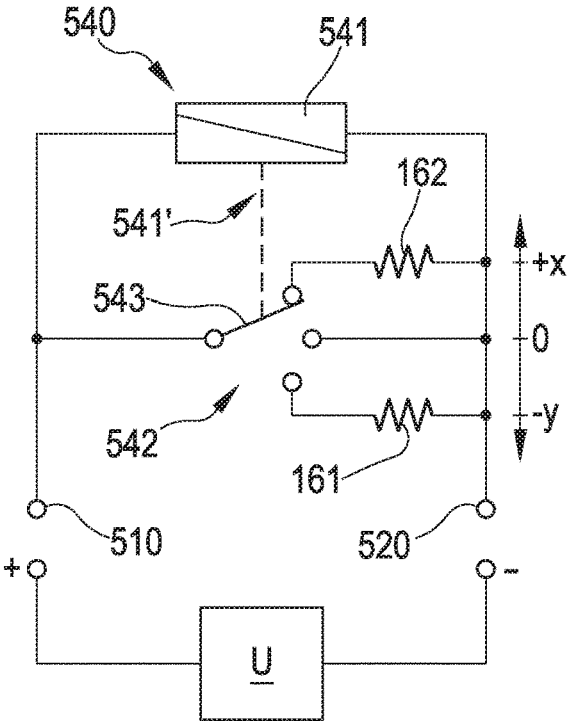
FIG. 5A shows the electrical diagram of the door-lock device according to FIG. 5, in which the door of the household appliance is closed.
Figure 5B:
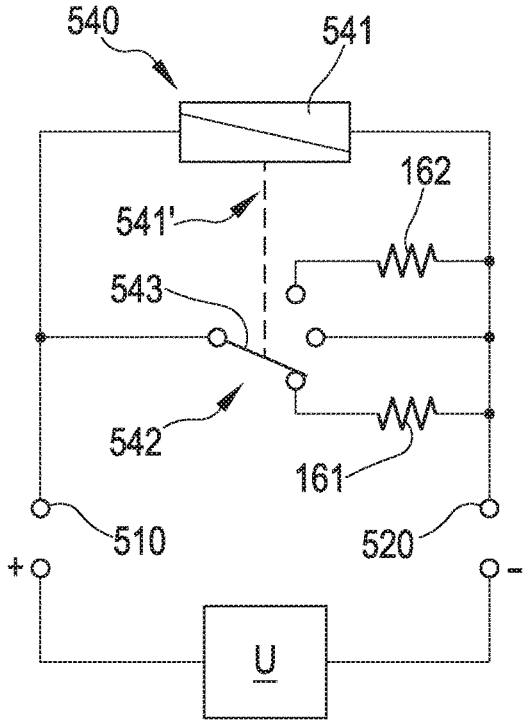
FIG. 5B shows the electrical diagram of the door-lock device according to FIG. 5, in which the door of the household appliance is locked.
Figure 5C:
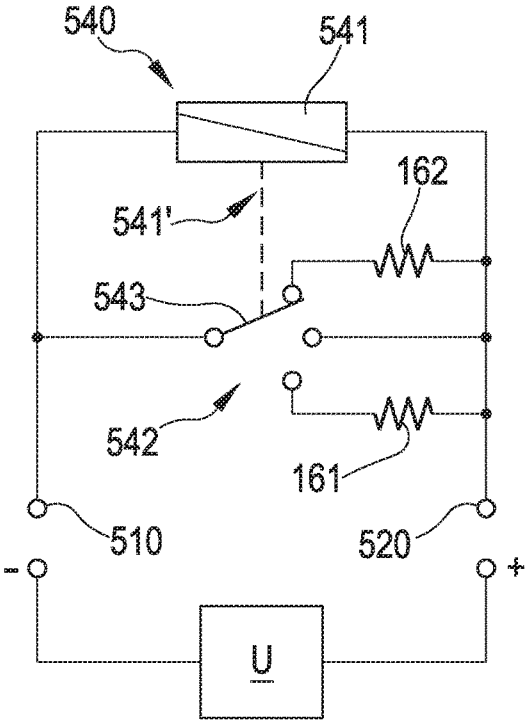
FIG. 5C shows the electrical diagram of the door-lock device according to FIG. 5, in which the door of the household appliance is unlocked.
Figure 5D:
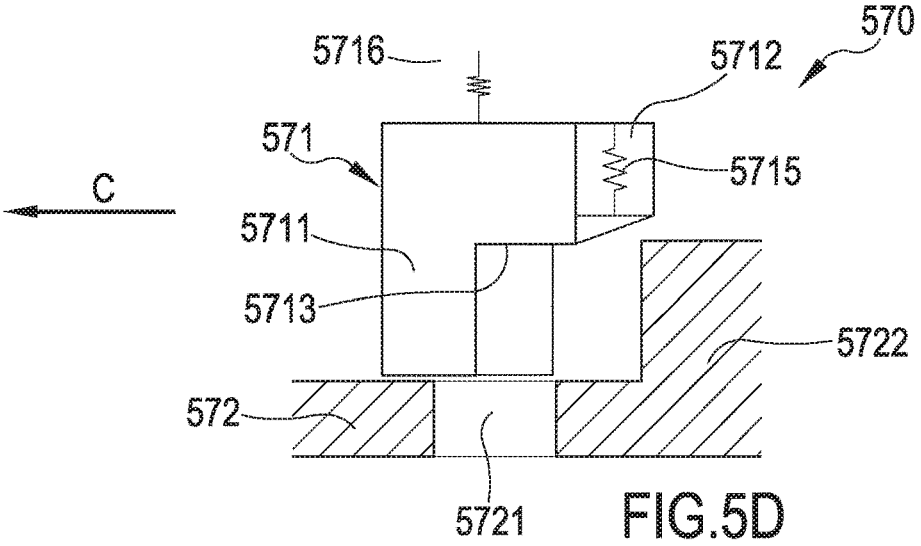
FIG. 5D shows the structural diagram of an assembly for actuating the door-lock device according to FIG. 5 with the door open.
Figure 5E:
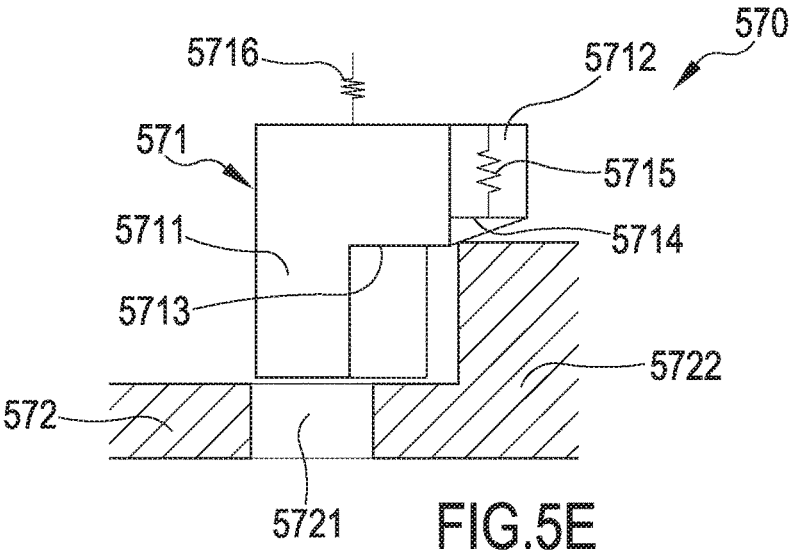
FIG. 5E shows the actuating assembly of FIG. 5D when the door of the household appliance is closed, not locked.
Figure 5F:
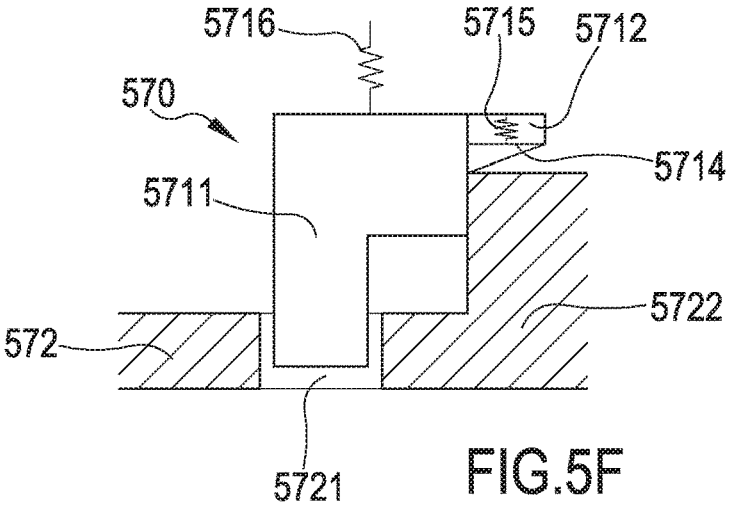
FIG. 5F shows the actuating assembly of FIG. 5D when the door of the household appliance is locked.
Figure 5G:
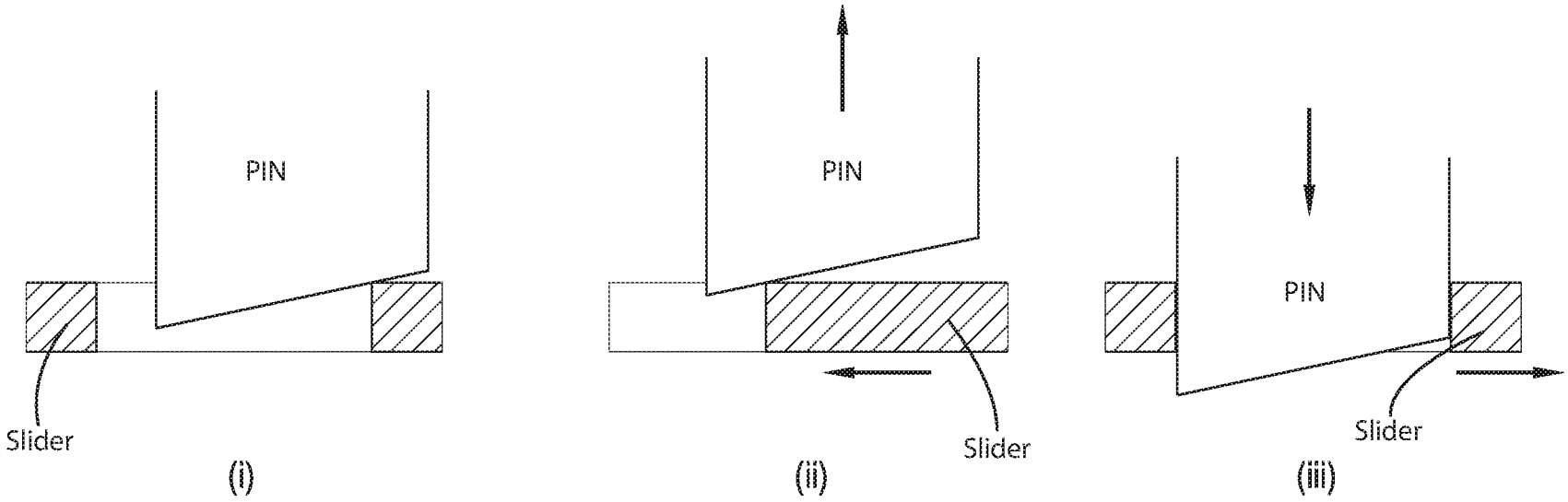
FIG. 5G shows the different arrangements of a generic pin with respect to a blocking slider of a door of a household appliance.

To better explain the operation of the door-lock device 500, reference is made by way of example to FIG. 5G. In said figure, analyzing it from left to right, the positioning sequence of a generic locking pin with respect to a locking slider is shown. In particular:

- in the position shown in the figure with (i), the locking pin is in the position where the slider does not lock the door and the latter is open;
- in the position shown in the figure with (ii), the door is closed and therefore the door hook physically moves the slider according to the arrow shown in the figure, thus causing the locking pin to be lifted upwards;
- in the position shown in figure with (iii), a locking device forces the lowering of the locking pin towards the bottom, making the slider to slide in the opposite direction with respect to position (ii), in such a way as to lock the door.

This operating configuration is not allowed for legal regulations, since, for safety reasons, the locking pin cannot force the movement of the slider which effectively locks the door.

In any case, it is seen that the locking pin assumes an intermediate position, when the door is open, a raised position, when the door is closed but not locked, and finally, a lowered position, when the door is locked. These three positions are used to understand the status of the door-lock device in the three different configurations of open door, unlocked closed door and locked closed door.

In fact, using these three different positions of the locking pin it is possible to have a system that does not have a switch dedicated to detect the opening and closing state of the door as in the other cases described above.

FIG. 5D is now considered, in which the actuating assembly 570 of the door-lock device 500 according to the present invention is shown.

Said actuating assembly 570 comprises a locking pin 571 and a slider 572 (commonly called slider, which interacts with a hook of a door-lock device as it is known in the art).

Said locking pin 571 comprises a first portion 5711, having a first step 5713, a second portion 5712, coupled with said first portion 5711, and having a wedge 5714 having an angled surface, a compressing spring 5715, arranged to retain said wedge 5714 in a lowered position, and a thrusting spring 5716, connected to said locking pin 571, having a resistance to the compression smaller than said compressing spring 5715. Said thrusting spring 5716 being adapted to hold said pin 571 in a lowered position.

The slider 572 has an opening 5721, in which said locking pin 571 can be inserted, and a second step 5722, arranged so as to interact with said wedge 5714. The operation of said step 5722 will be better explained in the following.

Said locking pin 571 is capable of assuming a raised position and a lowered position, in which said first portion 5711 is inserted in said opening 5721 of said slider 572, in addition to an intermediate position between the two.

The operation of the door-lock device 500 described above is as follows.

When the door of the household appliance is open, the selector 543 of the switch 542 of the actuator 540 is in the intermediate position as shown in FIG. 5.

Therefore, the locking pin 571 of said actuating assembly 570 is in the position shown in FIG. 5D, i.e. the locking pin 571 is offset with respect to the opening 5721 of said slider 572. In this condition, the locking pin 571 is located at an intermediate height.

When the door of the household appliance closes, the slider 572 is moved by the hook of the door (not shown in the figure) according to the arrow C, as shown in FIG. 5E and the slider 572, due to the wedge 5714, tends to raise the locking pin 571, acting against the spring 5716, which in the previous configuration was in a free length condition without exerting any action.

In this configuration the locking pin 571 is aligned with the hole 5721 of the slider 572, ready to engage it, locking the door of the household appliance (lockability condition).

In this way, the selector 543, which is integral with the locking pin 571, moves, as shown in FIG. 5A, to a position such as to select the resistance 162.

The central control unit U, therefore, reads an impedance variation at the ends of said first 510 and second 520 connecting terminal, detecting that the door of the household appliance is closed.

To lock the door of the household appliance, the central control unit U supplies the coil 541 of said actuator 540, so that the respective movable core 541 moves the selector 543 of said switch 542, so as to select the resistance 161, as shown in FIG. 5B.

Since the selector 543 is integral with said locking pin 571, the same is forced to be inserted in said opening 5721 of said slider 572, thus locking the door closed. At the same time, the compressing spring 5715 is compressed, as shown in FIG. 5F.

Moreover, the central control unit U still reads a new impedance thus detecting that the door is locked. The resistances 161 and 162 in fact have different values between them and different from zero.

To open the door, the central control unit U drives the coil 541, so as to move the movable core 541', such that the selector 543 of the switch 542 selects again the resistance 162 (see FIG. 5C) and, simultaneously, the locking pin 571 is raised and then extracted from said opening 5721 of said slider 572.

In this way, with the new reading of the impedance at the ends of said first 510 and second 520 connecting terminal, the central control unit U detects that the door is unlocked.

By opening at this point the door of the household appliance, the slider 572 moves in the opposite direction with respect to the arrow shown in FIG. 5E, allowing the spring 5716 (which was compressed) to move the slider 572 downwards and to pass the selector 543 on the branch without resistance, which short-circuits the two ends 510 and 520 of the door-lock device 500. On the ends 510 and 520 there will be an impedance value which will be different with respect to the two previous cases of closed/locked and closed/unlocked door.

In this case, to carry out the locking and unlocking operations it is necessary to invert the polarity of the supply at the ends of the terminals 510 and 520 of the door-lock device 500.

Figure 6:
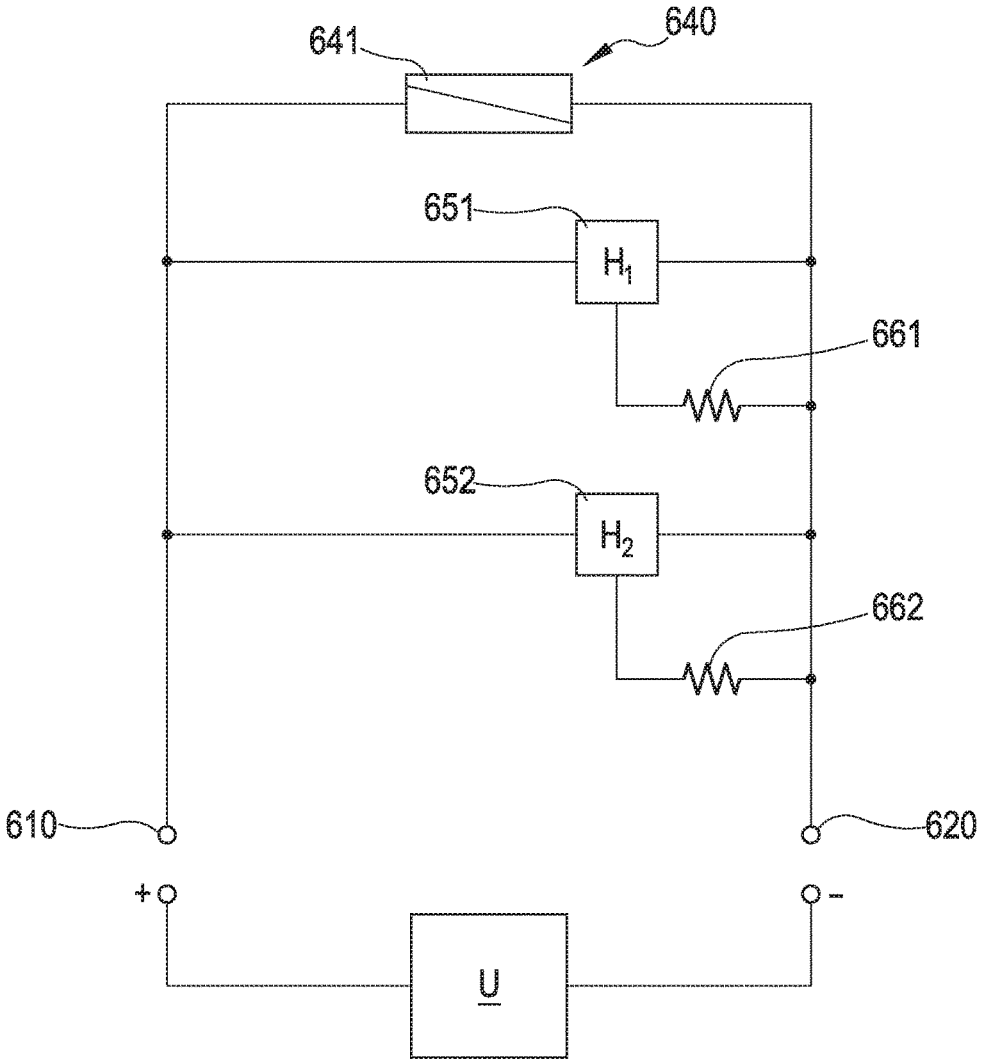
FIG. 6 shows the electrical diagram of a sixth embodiment of a door-lock device according to the present invention.

With reference to FIG. 6, a sixth embodiment of the door-lock device 600 according to the present invention is seen, which appears as a variant of the previous one. This variant is implemented by eliminating all the electrical contacts previously described with the Hall sensors 651 and 652.

In this solution, therefore, there is a door-lock device 600, which has no contacts both for the definition of an open or closed door and of a closed door, in the two configurations of a locked or unlocked door.

In particular, in this configuration the whole part concerning the kinematics of the locking pin remains unchanged with the possibility of going to discriminate the three states of the door-lock (door open, door closed locked and door closed unlocked) from the only position of the locking pin, and in particular by its coordinate along its trajectory.

In particular, in the circuit shown, the actuator 640 is made of a coil 641, capable of interacting by means of its movable core (not shown in the figure) with an actuating assembly 670, comprising, in particular, a locking pin 671 having, preferably, a magnet 672 interacting with the position of this locking pin and which changes its position in the space due to the displacement of the locking pin.

The door-lock device 600 comprises in particular two Hall sensors, respectively indicated with the numerical references 651 and 652, each of which is suitably polarized with a respective biasing resistance, respectively indicated with the numerical references 661 and 662.

Said Hall sensors 651 and 652 are arranged close to said locking pin 671, such that, following the movement of said locking pin 671, each of said Hall sensors 651 and 652 change their impedance according to the detected magnetic field, which varies in that the position of the locking pin and therefore of the magnet associated thereto varies. In a completely equivalent situation, the magnetic field could not be generated by a permanent magnet, but by a magnetic circuit inside the door-lock device 600, as indicated in the first embodiment described above, or with an actuator as indicated in the Italian patent application number 102017000039143 owned by the Applicant.

Equally, the sensors can be positioned in points of the door-lock device 600 which see a characteristic magnetic field for each of the three states of the household appliance door (door open, closed/locked and closed/unlocked). The magnetic field in these cases is that generated by the coils that made up the actuator and has its own circuit due to the ferromagnetic elements in the door block.

Figures 6A, 6B, 6C:
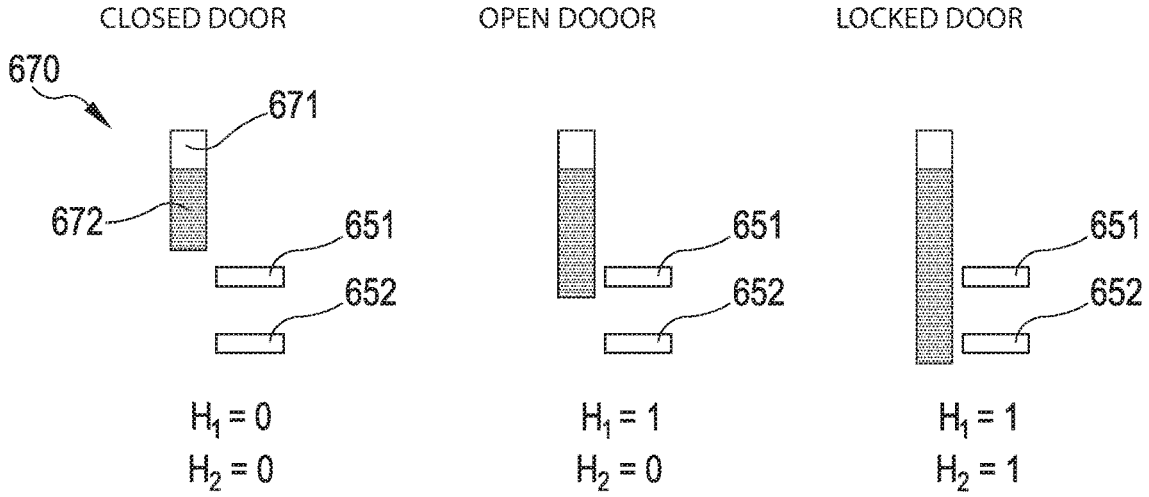
FIG. 6A shows the position of a locking pin with respect to the Hall sensors when the door of an actuating appliance is closed.
FIG. 6B shows the position of a pin with respect to the Hall sensors when the door of a household appliance is open.
FIG. 6C shows the position of a pin with respect to the Hall sensors when the door of an actuating appliance is locked.

In particular, by way of example, in FIG. 6A the locking pin 671 can be observed in the position in which the door is closed, in FIG. 6B the locking pin 671 can be observed in a position in which the door is open, and finally in the position shown in FIG. 6C the locking pin 671 can be seen in the position in which the door is locked.

In each of said positions, the permanent magnet 672 changes its position with respect to the two Hall sensors 651 and 652, so as to vary the impedance thereof and therefore at the ends of said first 610 and second 620 connecting terminal.

In this way, the central control unit U of the household appliance, connected to the ends of said first 610 and second 620 connecting terminal, is capable of detecting the different states of the household appliance door.

In this embodiment, as in the present, a polarization inversion is required for the operation of the system or for passing the system from a locked door to an unlocked door.

An advantage of the present invention is to propose a door-lock device capable of allowing a particularly effective control and detection of a door-lock device, also allowing easy programming of the central control units of the household appliances, to which said door-lock devices are intended to be installed.

It is also an advantage of the present invention providing that some door-lock devices can be driven by a single polarization.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A door lock device (100) for locking and unlocking a door of a household appliance comprising:

a first electrical connecting terminal (110);

a second electrical connecting terminal (120);

an electric circuit connected to at least one of said first connecting terminal (110) and said second connection terminal (120) and having a having a closing switch (130) adapted to close the electric circuit when the door of said household appliance is in a closed position, an actuator (140), connected to said first connecting terminal (110) and second connecting terminal (120), comprising a first coil and a second coil (141, 142) adapted to generate a magnetic field for locking and unlocking of said door, and a Hall sensor (151) connected between said first connecting terminal (110) and said second connecting terminal (120), arranged in parallel with said actuator (140);

wherein said Hall sensor (151) is arranged to detect said magnetic field of said actuator (140).

2. The door-lock device (100) according to claim 1, wherein said Hall sensor (151) comprises three terminals (151', 151", 151'"), wherein two terminals (151', 151") are connected to said first (110) and second (120) connecting terminals, while the third terminal (151'") is connected, by means of a resistor (160), to said first connecting terminal (110).

3. The door-lock device (100) according to claim 1, wherein said actuator (140) is operatively associated to an actuating assembly (170), wherein the field generated by at least one of said first and second coils (141, 142) causes to lock and unlock said The door of said household appliance.

4. The door-lock device (100) according to claim 3, wherein said actuating assembly (170) comprises an actuating member (171) pivoted about a fulcrum (172) to rotate, wherein said actuating member is capable of being in first and second positions (142), according to the magnetic field generated by at least of said first and second coils (141, 142), a pin (173) coupled at an end to said actuating member (171) and such that:

when said actuating member (171) is in said first position, said pin (173) is retracted, and when said actuating member (171) is in said second position, said pin (173) is extracted, so as to cause the locking of said The door when it is closed.

5. The door-lock device (100) according to claim 4, wherein said actuating member (171) is "V"-shaped and said fulcrum (172) is arranged on a vertex of said actuating member (171).

6. The door-lock device (100) according to claim 4, wherein said actuating member (171) is made of magnetically permeable material.

7. The door-lock device (100) according to claim 2, wherein said actuator (140) is operatively associated to an actuating assembly (170), wherein the field generated by at least one of said first and second coils (141, 142) causes to lock and unlock said The door of said household appliance.

8. The door-lock device (100) according to claim 1, wherein said actuator (140) is operatively associated to an actuating assembly (170), wherein the field generated by at least of said first and second coils (141, 142) causes to lock and unlock said The door of said household appliance.

9. The door-lock device (100) according to claim 2, wherein said actuating assembly (170) comprises an actuating member (171) pivoted about a fulcrum (172) to rotate, wherein said actuating member is capable of being in first and second positions (142), according to the magnetic field generated by at least of said first and second coils (141, 142), a pin (173) coupled at an end to said actuating member (171) such that:

when said actuating member (171) is in said first position, said pin (173) is retracted, and when said actuating member (171) is in said second position, said pin (173) is extracted, so as to cause the locking of said The door when it is closed.

10. The door-lock device (100) according to claim 1, wherein said actuating assembly (170) comprises an actuating member (171) pivoted about a fulcrum (172) to rotate, wherein said actuating member is capable of being in first and second positions (142), according to the magnetic field generated by at least of said first and second coils (141, 142), a pin (173) coupled at an end to said actuating member (171) and such that:

when said actuating member (171) is in said first position, said pin (173) is retracted, and when said actuating member (171) is in said second position, said pin (173) is extracted, so as to cause the locking of said The door when it is closed.

11. The door-lock device (100) according to claim 3, wherein said actuating assembly (170) comprises an actuating member (171) pivoted about a fulcrum (172) to rotate, wherein said actuating member is capable being in first and second positions (142), according to the magnetic field generated by at least one of said first and second coils (141, 142), a pin (173) coupled at an end to said actuating member (171) such that:

when said actuating member (171) is in said first position, said pin (173) is retracted, and when said actuating member (171) is in said second position, said pin (173) is extracted, so as to cause the locking of said The door when it is closed.

12. The door-lock device (100) according to claim 4, wherein said actuating member (171) is "V"-shaped.

13. The door-lock device (100) according to claim 3, wherein said actuating member (171) is "V"-shaped.

14. The door-lock device (100) according to claim 13, wherein said actuating member (171) pivoted about a fulcrum (172) to rotate; wherein said fulcrum (172) is arranged on a vertex of said actuating member (171).

15. The door-lock device (100) according to claim 12, wherein said fulcrum (172) is arranged on a vertex of said actuating member (171).

16. The door-lock device (100) according to claim 5, wherein said actuating member (171) is made of magnetically permeable material.

* * * * *